US006789937B2

(12) United States Patent
Haddad et al.

(10) Patent No.: US 6,789,937 B2
(45) Date of Patent: Sep. 14, 2004

(54) METHOD OF PREDICTING FORMATION TEMPERATURE

(75) Inventors: Sammy Haddad, Mandeville, LA (US); Yueming Cheng, College Station, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/006,612

(22) Filed: Nov. 30, 2001

(65) Prior Publication Data

US 2003/0103551 A1 Jun. 5, 2003

(51) Int. Cl.[7] ..... G01K 13/00; G01K 3/00
(52) U.S. Cl. ..... 374/136; 374/102
(58) Field of Search ..... 374/102, 103, 374/104, 135, 136, 137, 141, 110; 75/597; 702/9; 703/10

(56) References Cited

U.S. PATENT DOCUMENTS

| | | | | |
|---|---|---|---|---|
| 3,417,827 A | * | 12/1968 | Smith et al. | 175/4.52 |
| 3,683,688 A | * | 8/1972 | Allaud | 73/152.12 |
| 3,913,398 A | * | 10/1975 | Curtis | 73/152.33 |
| 4,120,199 A | * | 10/1978 | Mufti | 73/152.12 |
| 4,370,886 A | * | 2/1983 | Smith et al. | 73/152.42 |
| 4,507,957 A | | 4/1985 | Montgomery et al. | |
| 4,520,666 A | * | 6/1985 | Coblentz et al. | 73/152.33 |
| 4,535,843 A | * | 8/1985 | Jageler | 166/250.01 |
| 4,575,261 A | * | 3/1986 | Berger et al. | 374/136 |
| 4,809,236 A | * | 2/1989 | Hsu et al. | 367/28 |
| 4,821,164 A | * | 4/1989 | Swanson | 702/5 |
| 4,860,581 A | | 8/1989 | Zimmerman et al. | |
| 4,936,139 A | | 6/1990 | Zimmerman et al. | |
| 4,947,682 A | * | 8/1990 | Anderson et al. | 73/152.12 |
| 4,994,671 A | | 2/1991 | Safinya et al. | |
| 5,159,569 A | * | 10/1992 | Xu et al. | 702/13 |
| 5,303,775 A | | 4/1994 | Michaels et al. | |
| 5,321,612 A | * | 6/1994 | Stewart | 702/13 |
| 5,675,147 A | * | 10/1997 | Ekstrom et al. | 250/152.12 |
| 5,703,286 A | * | 12/1997 | Proett et al. | 73/152.05 |
| 6,111,408 A | | 8/2000 | Blades et al. | |
| 6,167,348 A | * | 12/2000 | Cannon | 702/13 |

FOREIGN PATENT DOCUMENTS

| | | | | |
|---|---|---|---|---|
| WO | WO 9708424 A1 | * | 3/1997 | E21B/17/20 |
| WO | WO 02/057595 | | 7/2002 | |

OTHER PUBLICATIONS

L. R. Raymond, *Temperature Distribution in a Circulating Drilling Fluid*, Journal of Petroleum Technology, pp. 333–341 (Mar. 1969).

C. S. Kabir et al., *Determining Circulating Fluid Temperature in Drilling, Workover, and Well–Control Operations*, SPE Drilling & Completion, pp. 74–79 (Jun. 1996).

H. H. Keller et al., Temperature Distribution in Circulating Mud Columns, Society of Petroleum Engineers Journal, pp. 23–30 (Feb. 1973).

(List continued on next page.)

*Primary Examiner*—Diego Gutierrez
*Assistant Examiner*—Mirellys Jagan
(74) *Attorney, Agent, or Firm*—J. L. Jennie Salazar; Brigitte E. Echols; John Ryberg

(57) ABSTRACT

The present invention discloses a method of calculating a static formation temperature in a reservoir penetrated by a wellbore. One embodiment of the present invention comprises estimating the static formation temperature and calculating a formation fluid temperature at the wellbore, the calculation based, in part, on the estimated static formation temperature. The temperature of a sample of formation fluid at the wellbore is measured. The calculated formation fluid temperature at the wellbore is compared with the measured temperature of the sample of formation fluid. The static formation temperature is predicted by altering the estimate of the static formation temperature until an error between the calculated formation fluid temperature at the wellbore and the measured fluid formation temperature is minimized.

20 Claims, 5 Drawing Sheets-

OTHER PUBLICATIONS

S. V. Kashikar et al., *Determination of Formation Temperature From Flow Tests: A New Solution*, Society of Petroleum Engineers Production Operations Symposium, pp. 701–713 (Apr. 1991).

Brian Roux et al., *An Improved Approach to Estimating True Reservoir Temperature From Transient Temperature Data*, Society of Petroleum Engineers California Regional Meeting, pp. 1–8 (Apr. 1980).

A. R. Hassan et al., *Determination of Static Reservoir Temperature From Transient Data Following Mud Circulation*, Society of Petroleum Engineers Western Regional Meeting, pp. 565–574 (Apr. 1992).

H. J. Ramey, Jr. *Wellbore Heat Transmission*, Society of Petroleum Engineers Annual Fall Meeting, pp. 427–435 (Oct. 1961).

C. S. Kabir et al., *Establishing Geothermal Gradient Using a New Static Temperature Analysis Method*, Society of Petroleum Engineers Annual Technical Conference and Exhibit, pp. 267–274 (Oct. 1997).

Peter Goode et al., *Permeability Determination With a Multiprobe Formation Tester*, Society of Petroleum Engineers Formation Evaluation, pp. 297–303 and 218–224 (Dec. 1992).

J. Bouton et al., *Assessment of Sample Contamination by Downhole NMR Fluid Analysis*, Society of Petroleum Engineers Annual Technical Conference and Exhibition, pp. 1–10 (Oct. 2001).

Schoeppel, Roger J. et al., "Numerical Simulation of Borehole and Formation Temperature Distributions while Drilling to Total Depth", SPE 3364, Oct. 3–6, 1971, pp. 1–10.

* cited by examiner

METHOD OF PREDICTING FORMATION TEMPERATURE

BACKGROUND OF THE INVENTION

1. Field of the Invention

This invention relates generally to the prediction of formation temperatures in a subsurface formation and, more particularly, to the prediction of the temperature of a hydrocarbon formation temperature.

2. Description of Related Art

Hydrocarbon fluids, such as oil and natural gas, are obtained from a subterranean geologic formation, referred to as a reservoir, by drilling a well that penetrates the hydrocarbon-bearing formation. An understanding of the undisturbed reservoir temperature is desirable for numerous applications involved in the drilling, completion and production of reservoir fluids. These applications may include, for example: drilling fluid and cement slurry design; log interpretations; corrosion tendencies in wellbore tubulars and downhole equipment; hydrocarbon reserve estimation; flow assurance design; and estimations of geothermal energy, etc.

In drilling operations, the formation temperature has a direct bearing on drilling fluid rheology and therefore has to be considered in drilling fluid and wellbore design. The formation temperature directly impacts cement dehydration and cure times, and therefore needs to be considered in the design of casing and cementing programs. The interpretation of electric logs requires accurate formation resistivities, which are dependent on temperature. In production and well-control operations, accurate computations of fluid flow rates are important. Fluid temperature, both as a function of depth and elapsed time, dictates fluid properties such as density and viscosity, and therefore influences the pressure drops and/or the maximum allowable production rates that can be achieved. Flow assurance design considerations, such as hydrate formation and paraffin deposition prevention, depend on an accurate knowledge of the reservoir temperature.

As a wellbore is drilled, a temperature disturbance is introduced by the circulating drilling fluids, thereby cooling the formation around the borehole. The initial undisturbed formation temperature exists only at a certain distance away from the wellbore. During the circulation of fluids, often referred to as "mud", the temperature within the borehole drops and reaches a pseudo-steady state condition in a very short time. After a certain period of time, the temperature within the wellbore during fluid circulation can be considered constant. Earlier studies have indicated that a constant temperature difference between the bottom-hole fluid and wellbore wall is achieved almost immediately and maintained throughout the life of the wellbore fluid circulation process. This means that the heat transmission from the formation to the wellbore during wellbore fluid circulation is a constant heat flux dominated process. Therefore, during mud circulation, the heat transfer between the wellbore and the formation can be described with a constant heat flux solution of an infinite reservoir. See Raymond, L. R.: "*Temperature Distribution in a Circulating Drilling Fluid*", JPT, March 1969; and Schoeppel, R. J., Bennet, R. E.: "*Numerical Simulation of Borehole and Formation Temperature Distributions While Drilling to Total Depth*", SPE paper 3364, presented October 1971.

The amount of departure from the undisturbed formation temperature during drilling and completion operations depends upon several factors, such as, the original temperature distribution, the physical properties of the reservoir rock and the drilling/completion fluids. Fluid circulation rates and duration, and the tubular and cementation design used on the well are also factors that influence the temperature profile. Formation temperatures are often estimated by using temperature measurements taken inside the wellbore, often in conjunction with well logging and fluid sampling.

The process of formation fluid sampling typically involves the lowering of a sampling tool into the wellbore. The sampling tool collects one or more samples of formation fluid by the engagement between a probe module of the sampling tool and the wall of the wellbore. Embodiments of sampling tools may comprise more than a single probe, such as with dual-probe or multi-probe modules, enabling the sampling of differing sites within the formation within a single deployment of the sampling tool. There are several commercially available sample tools available, for example the Modular Dynamics Formation Tester (MDT™) made by Schlumberger, the Reservoir Characterization Instrument (RCI$^{SM}$) from Baker Atlas, and the Reservoir Description Tool (RDT™) tool made by Halliburton.

The Modular Dynamics Formation Tester (MDT) formation testing tool, owned and provided by Schlumberger operates by creating a pressure differential across an engagement of a probe module with the wellbore to induce formation fluid flow into one or more sample chambers within the sampling tool. This and similar processes are described in U.S. Pat. Nos. 4,860,581; 4,936,139 (both assigned to Schlumberger). Due to the changes in the temperature field surrounding the wellbore discussed above, the temperature data acquired by the MDT is typically lower than the actual static formation temperature, because of short sampling time. One distinct feature of wireline pretest and sampling is that the flow regime is primarily controlled by three-dimensional (3-D) spherical or radial flow where the probe functions as a point sink. Therefore, the specific difficulty in determining the original formation temperature is the calculation of the fluid temperature at the probe during the recording, which is associated with 3-D spherical flow.

Another sampling tool is the Reservoir Characterization Instrument (RCI), provided by Baker Atlas. It can comprise an optical analyzer, named SampleView$^{SM}$, that can be used to monitor contamination levels within sample formation fluids pumped through the tool, and can be run with other reservoir characterization sensors. Examples of other reservoir characterization sensors include pressure sensors and sensors that measure the apparent dielectric constant of the sample fluid, thereby distinguishing oil, gas and water within the sample fluids. The quality of a reservoir fluid sample and the time required to acquire the sample can be predicted utilizing a three-dimensional fluid flow simulation model and input data acquired from the RCI, such as formation pressure, formation permeabilities, and formation fluid properties.

Still another sampling tool that can be utilized with the present invention includes the Reservoir Description Tool (RDT) tool manufactured by Halliburton. It can comprise a modular apparatus that uses nuclear magnetic resonance (NMR) techniques for making downhole NMR measurements of the formation fluid samples, as described in U.S. Pat. No. 6,111,408 to Blades et al.

Referring to the attached drawings, FIG. 1 illustrates a prior art representative drilling/production platform 10 having a tubular string 12 extending into a wellbore 14. The wellbore 14 has penetrated subterranean formations 16, and intersects a productive reservoir 18. A casing string 20 lines the well and provides support and isolation of the wellbore 14 from the formations 16 and bodies of water 22. Wellbore drilling or completion fluids 24, commonly referred to as "mud", are typically circulated down the tubular string 12 and up the wellbore 14. The circulation of wellbore fluids 24 results in the cooling of the reservoir 18 around the wellbore 14. Upon the cessation of fluid circulation, the tubing 12 can be removed from the wellbore 14.

FIG. 2 illustrates a prior art representative drilling/production platform 10 having a downhole tool 26 inserted into the wellbore 14 on a wireline 28. The downhole tool 26 can comprise a formation-testing tool capable of collecting one or more samples of formation fluid, such as, for example, the Modular Dynamics Formation Tester (MDT) formation-testing tool. In addition to obtaining a sample of the formation fluid coming from the reservoir 18, the downhole tool 26 may also collect data such as temperature and pressure readings. Embodiments of the downhole tool 26 can be run into the well on a tubing string, slickline, wireline, or by other means of positioning the tool within the reservoir 18. The temperature T of the formation fluids from the reservoir adjacent the wellbore is lower than the original undisturbed temperature of the formation Te, sometimes referred to as the initial or static reservoir temperature or formation temperature. When the circulation of the wellbore fluids 24 is stopped, the wellbore fluid 24 temperature Tm begins to increase due to the influence of the higher temperatures within the reservoir 18.

FIG. 3 illustrates a prior art embodiment of an MDT formation testing tool 30 that can be utilized in both formation fluid sampling and pretest operations. Various pretest operations can involve flowing formation fluids for a desired amount of time to obtain a specific quantity of fluid removal from the formation, or can comprise flowing a well until a desired pressure drawdown has occurred, in order to measure the pressure recovery or buildup rate. The tool 30 comprises a pump 32 that induces flow of reservoir fluid into a fluid probe 46, along a flowline 34, and then out to the wellbore 14. The flow of reservoir fluid can last an extended period of time to reduce contamination and obtain a better quality reservoir fluid sample, or to provide a desired amount of pretest flow prior to a pressure buildup test or other formation analysis. If it is desired to collect a sample, the opening of seal valves 36, 38 divert a portion of the fluid flow into a sample chamber 40. Any initial fluid that is in the sample chamber 40 can be flushed with the formation fluid. A piston 42 within the tool 30 can move and displace fluid from a buffer chamber 44, thus allowing formation fluid to enter the sample chamber 40. The closing of the seal valves 36, 38 contain the fluid sample within the sample chamber 40 for removal from the wellbore 14 and analysis.

The ability to flow the formation fluid prior to taking a sample enables the MDT tool 30 to provide a more representative sample of the formation fluid by minimizing near wellbore factors such as lost drilling fluids and residual drilling mud from contaminating the sample fluids. The MDT tool 30 can comprise a temperature sensor that records the temperature of the reservoir fluids passing through the flowline 34 during the testing time period.

Current methods to determine the initial reservoir temperature are typically based on extrapolated shut-in temperature recordings. These methods typically require long shut-in periods and result in estimates that are lower than the true reservoir temperature. Complete temperature recovery in the area near the wellbore may take anywhere from a few hours to a few months, depending on the formation, well characteristics, and the mud circulating time. Since a long waiting period for complete temperature recovery can result in a significant increase in drilling costs; a less time consuming method is needed to calculate static reservoir temperature using early shut-in and test data.

SUMMARY OF THE INVENTION

One embodiment of the present invention is a method of calculating a static formation temperature in a reservoir penetrated by a wellbore. The method comprises estimating the static formation temperature and calculating a formation fluid temperature at the wellbore, the calculation based, in part, on the estimated static formation temperature. The temperature of a sample of formation fluid at the wellbore is measured. The calculated formation fluid temperature at the wellbore is compared with the measured temperature of the sample of formation fluid. The static formation temperature is predicted by altering the estimate of the static formation temperature until an error between the calculated formation fluid temperature at the wellbore and the measured fluid formation temperature is minimized.

An alternate embodiment of the present invention is a method of calculating a static formation temperature in a reservoir penetrated by a wellbore comprising: estimating the static formation temperature in the reservoir and a wellbore fluid temperature. A calculated formation fluid temperature at the wellbore versus time profile is created for fluid removed from the formation by a sink probe, based upon, in part, the estimates of the static formation temperature in the reservoir and the wellbore fluid temperature. The temperature of the formation fluid at the wellbore removed from the formation by the sink probe is measured, and a measured fluid formation temperature at the wellbore versus time profile is created. The measured fluid formation temperature at the wellbore versus time profile is compared to the calculated formation fluid temperature at the wellbore versus time profile. The static formation temperature is predicted by altering the estimates of the static formation temperature in the reservoir and a wellbore fluid temperature until the error between the measured fluid formation temperature at the wellbore versus time profile to the calculated formation fluid temperature at the wellbore versus time profile is minimized.

BRIEF DESCRIPTION OF THE DRAWINGS

The invention may be understood by reference to the following description taken in conjunction with the accompanying drawings, in which like reference numerals identify like elements, and in which.

DESCRIPTION OF ILLUSTRATIVE EMBODIMENTS

Temperature Distribution Prediction

Figure 1:
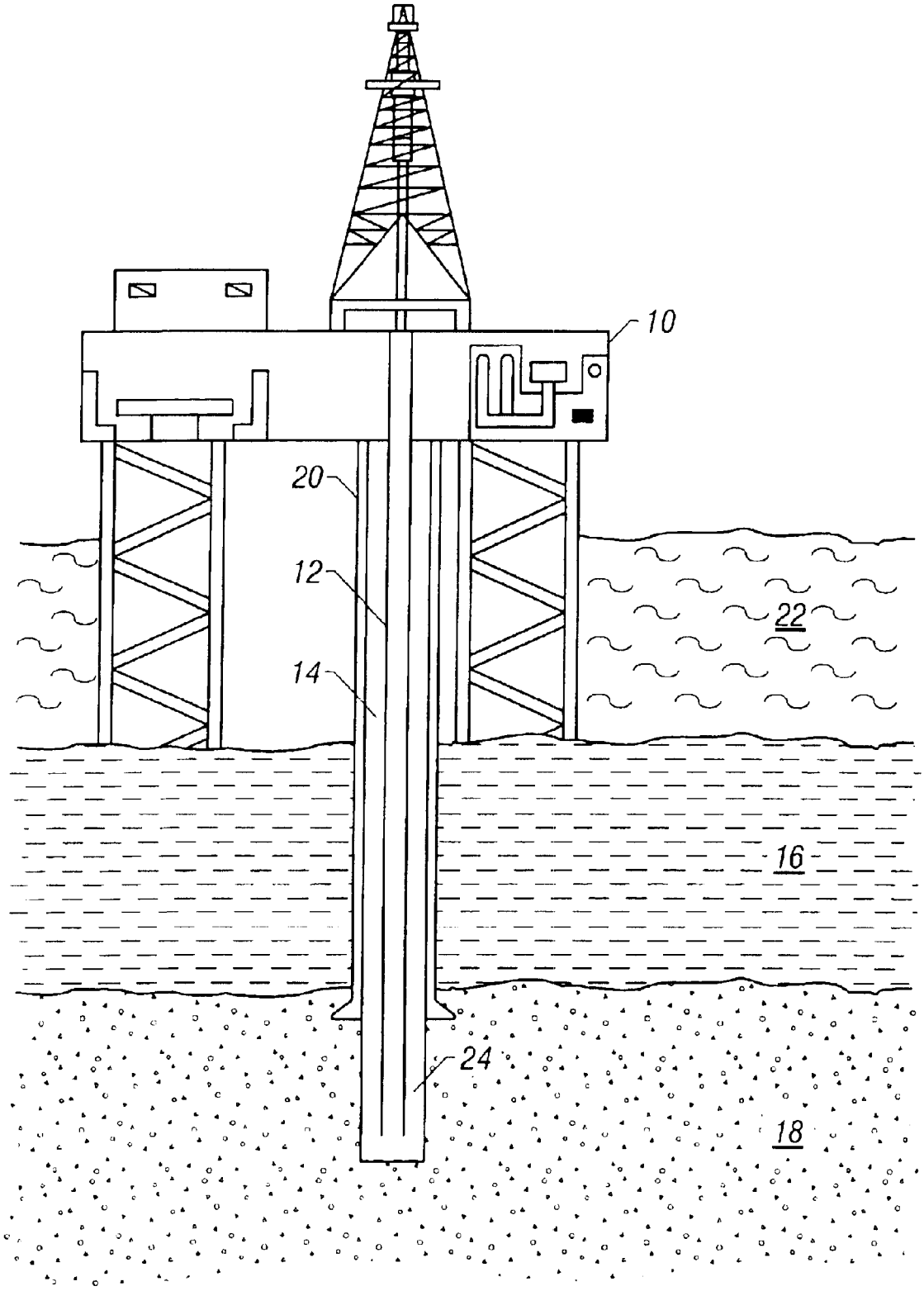
FIG. 1 (Prior Art)
FIG. 1 illustrates a prior art representative drilling/production platform.
Figure 2:
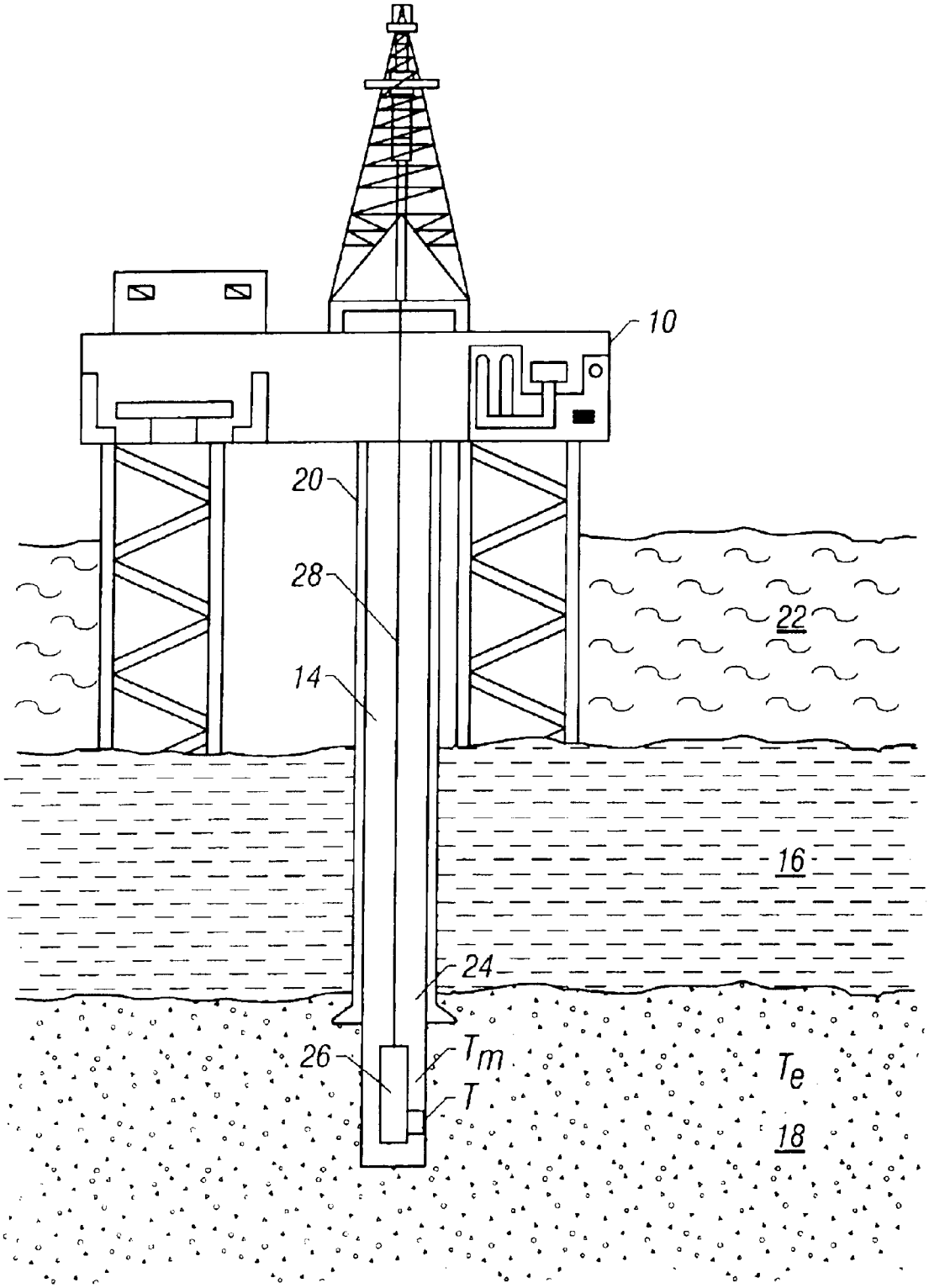
FIG. 2 (Prior Art)
FIG. 2 illustrates a prior art representative drilling/production platform comprising a formation-testing tool.
Figure 3:
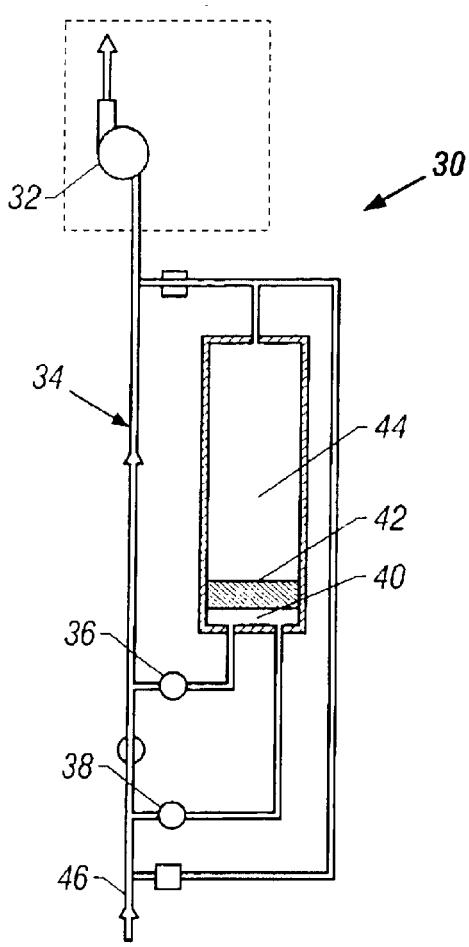
FIG. 3 (Prior Art)
FIG. 3 schematically illustrates a prior art embodiment of an MDT formation testing tool.

During the circulation of fluids within a wellbore, the temperature within the wellbore drops and reaches a pseudo-steady state condition in a very short time. The temperature within the wellbore during fluid circulation can be considered constant. A constant temperature difference between the bottom-hole fluid and wellbore wall is achieved almost immediately and maintained throughout the life of the wellbore fluid circulation process. This means that the heat transmission between the wellbore and formation is a constant-heat-flux dominated process. Therefore, during mud circulation, the heat transfer between the wellbore and formation can be described with a constant-heat-flux solution of an infinite reservoir.

Applying the constant-heat-flux linear source solution, the temperature T at a point in the formation at any time t can be expressed as:

$$T = Te - \frac{Q}{2\pi H k_f} f(r, t) \tag{1}$$

$$f(r, t) = -\frac{1}{2} E_i\left(-\frac{r^2}{4\alpha t}\right) \tag{2}$$

Where Te is original formation temperature, Q is heat flow rate (=2πrHq), $k_f$ is thermal conductivity of formation, H is the reservoir thickness, q is heat flux, $E_i$ is the exponential integral function, α is the thermal diffusivity of the formation, r is the radius from the wellbore, and t is the time for mud circulation.

Based on the energy balance of the overall system, the heat rate can be written as:

$$Q = \frac{2\pi H(Te - Tm)}{\frac{1}{h_f r_w} + \frac{1}{k_f} f(r, t)\Big|_{r_w}} \tag{3}$$

Where $h_f$ is the heat transfer coefficient for fluid within the wellbore and $r_w$ is the wellbore radius. $T_M$ is the wellbore fluid temperature within the wellbore at the time of circulation cessation, which is a time-dependent variable. Since $T_M$ is usually not available in practice, it is treated as an adjustable parameter. Within this application the term wellbore fluid refers to the fluids that were circulated within the wellbore and remains within the wellbore during testing and does not refer to the formation fluid that is located within the formation matrix or the formation fluid that is removed from the formation by action of the sampling tool or probe.

After mud circulation stops, formation temperatures gradually build up. Assuming the heat flux rate is zero after mud circulation, by applying the superposition principle, the following equation can be obtained to express a one-dimensional radial temperature distribution during the period of temperature buildup (Δt).

$$T = Te - \frac{Q}{2\pi H k_f} f(r, t + \Delta t) + \frac{Q}{2\pi H k_f} f(r, \Delta t) \tag{4}$$

By estimating the wellbore fluid temperature TM and the original formation temperature Te, the value of Q can be calculated from equation (3). A calculated temperature T at a radial distance from the wellbore wall can be obtained versus time from equation (4), an example of which is shown graphically in FIG. 4, where curve 1 illustrates the temperature profile during mud circulation and curves 2–5 illustrate the temperature profiles at incremental times after circulation had stopped.

Fluid Flow Prediction

The next step in the methodology of the present invention involves calculation of three-dimensional fluid flow through space.

Fluid withdrawal at the sink probe can be treated as a continuous point source with strength $q_f$ on a cylindrical internal boundary of radius $r_w$ through which no temperature flux passes. For spherical fluid flow through space at a constant temperature caused by a continuous point source, Goode et al presented the pressure change at a point and time as follows:

$$\Delta p(t) = \frac{q_f}{4\varphi c_t \pi^{\frac{3}{2}} \sqrt{\eta_r^2 \eta_z}} \int_{\frac{1}{\sqrt{t}}}^{\infty} \exp\left\{-\frac{u^2}{4}\left[\frac{\alpha}{\eta_r} + \frac{(z - z_0)^2}{\eta_z}\right]\right\} du \tag{5}$$

Where $q_f$ is an approximately constant withdrawal rate of a single phase liquid and ($r_0$, $\theta_0$, $z_0$) are the cylindrical coordinates of the point source, and:

$$\alpha = r^2 + r_0^2 - 2rr_0\cos(\theta - \theta_0) \tag{6}$$

$$\eta_r = \frac{k_r}{\varphi \mu c_t} \tag{7}$$

$$\eta_z = \frac{k_z}{\varphi \mu c_t} \tag{8}$$

In order to obtain fluid flow equations, derivatives of pressure are taken with respect to r, θ, and z. The pressure gradients along r, θ, and z may then be written as:

$$\frac{\partial p}{\partial r} = \frac{A}{B} \frac{r - r_0\cos(\theta - \theta_0)}{2\eta_r}\left[\frac{1}{2\sqrt{t}}\exp\left(-\frac{B}{t}\right) + \frac{\sqrt{\pi}}{4\sqrt{B}} erfc\left(\frac{\sqrt{B}}{\sqrt{t}}\right)\right] \tag{9}$$

$$\frac{\partial p}{\partial \theta} = \frac{A}{B} \frac{rr_0\sin(\theta - \theta_0)}{2\eta_r}\left[\frac{1}{2\sqrt{t}}\exp\left(-\frac{B}{t}\right) + \frac{\sqrt{\pi}}{4\sqrt{B}} erfc\left(\frac{\sqrt{B}}{\sqrt{t}}\right)\right] \tag{10}$$

$$\frac{\partial p}{\partial z} = \frac{A}{B} \frac{z}{2\eta_z}\left[\frac{1}{2\sqrt{t}}\exp\left(-\frac{B}{t}\right) + \frac{\sqrt{\pi}}{4\sqrt{B}} erfc\left(\frac{\sqrt{B}}{\sqrt{t}}\right)\right] \tag{11}$$

Where erfc(x) is the error function, and $$A = \frac{q_f}{4\varphi c_t \pi^{\frac{3}{2}} \sqrt{\eta_r^2 \eta_z}} \tag{12}$$

$$B = \frac{1}{4}\left[\frac{\alpha}{\eta_r} + \frac{(z - z_0)^2}{\eta_z}\right] \tag{13}$$

Thus the velocity of a point in three-dimensional space at time t can be expressed as:

$$v_r(t) = -\frac{k_r}{\mu}\frac{\partial p}{\partial r} \tag{14}$$

-continued $$v_\theta(t) = -\frac{k_r}{\mu}\frac{\partial p}{\partial \theta}\frac{1}{r^2} \tag{15}$$

$$v_z(t) = -\frac{k_z}{\mu}\frac{\partial p}{\partial z} \tag{16}$$

and $$\Delta s = v\Delta t \tag{17}$$

Where s is the distance of a space point moving in the direction of r, θ, z within the time period At and v represents the velocity along the three directions. This is an analytic model, with which the location and velocity of a point in space can be calculated at any time.

Figure 5:
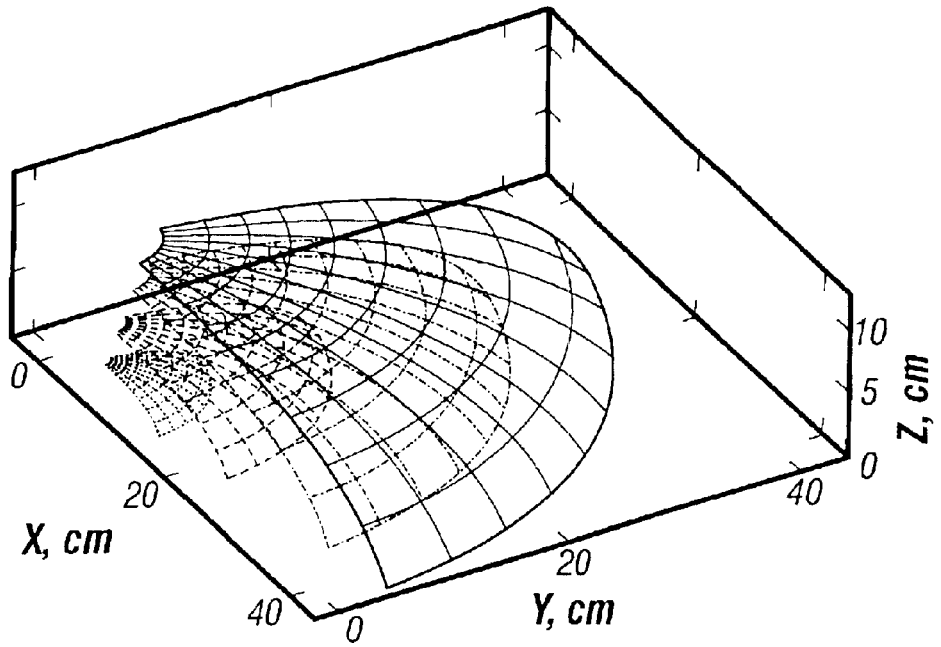
FIG. 5 graphically illustrates an example of calculated three-dimensional fluid flow profiles at various drawdown times. A spherical model is drawn within Cartesian coordinates for illustration purposes.

With this set of equations, the movement of fluid into the sink probe at different times can be tracked, and hence the starting point can be located. Therefore, by dividing a small sphere around the point source into a family of streamlines, the starting point of the streamlines at a particular time can be located. The starting point of the fluid movement represents the location of that fluid at the start of the testing period. FIG. 5 illustrates a portion of the solution of equations (5) through (17) at various drawdown times is shown in FIG. 5. Once the locations of the starting points of the streamlines are known within the formation, the various locations can be referenced as a radial distance from the wellbore wall.

Due to the relatively short testing time involved with use of sampling tools, it is assumed that the temperature distribution within the formation is kept constant during testing. Based on the radial temperature distribution prediction as expressed in equation (4), the temperatures at these starting points can be calculated. The average value of the starting point temperatures represents a calculated temperature of the fluid at the starting point. The fluid flow equations are capable of estimating the time at which the fluid from each starting point will reach the probe. By knowing the temperature of the fluid at the starting point and the time at which this particular fluid will enter the probe, a calculated temperature of the fluid at the probe can be determined with respect to time. Although this is an analytic model, a computer program may be used to complete the tracking of fluid movement along the streamlines to the probe.

The solving of equations (9) through (17) provides a series of solutions of radial distance (location of the fluid) versus time, which are then combined with the temperature versus radius solution of equations (1) through (4) to provide a calculated temperature at the probe at a particular time. An example of a graphical representation of the calculated temperature versus time solution is shown as curve 2 in FIG. 6. Varying the estimates of the wellbore fluid temperature Tm and the original formation temperature Te results in altering the calculated temperature versus time solution.

Formation Fluid Measurements

A downhole probe is inserted into the wellbore where it can receive formation fluid samples and take temperature measurements of the formation fluid over the testing time period. Typically the downhole probe is engaged to the wellbore wall where it can receive formation fluid without contamination from the wellbore fluids. The formation fluid is withdrawn from the reservoir at a substantially uniform withdrawal rate. The formation fluid temperature measurements are recorded and provide an observed formation fluid temperature at the wellbore versus time data.

Identifying Original Formation Temperature Through Optimization

To estimate the static formation temperature, the following objective function of the error E, between the observed and calculated temperatures is minimized:

$$E = \sum_{i=1}^{N_{MDT}} (T_i^{obs} - T_i^{cal})^2 \tag{18}$$

The wellbore fluid (mud) temperature Tm and initial formation temperature Te, are both adjustable parameters. The shape and slope of the calculated temperature plot is sensitive to the value of Tm, as well as the initial formation temperature Te. The observed temperature $T_{obs}$ of the fluid entering the probe with respect to time can then be compared to the calculated temperature $T_{cal}$ of the fluid entering the probe with respect to time. The error E, between these two temperature profiles is quantified in the solution of equation (18), yielding a measurement of the error between them. Adjustments can be made to the estimates of wellbore fluid temperature Tm and original reservoir temperature Te to minimize this error. By systematically adjusting the wellbore fluid temperature Tm and original reservoir temperature Te values, the error between the calculated and measured temperatures can be minimized, resulting in an accurate prediction of the initial reservoir temperature Te. This process provides a systematic method of determining the static reservoir temperature, without requiring a prolonged temperature buildup period.

Figure 7:
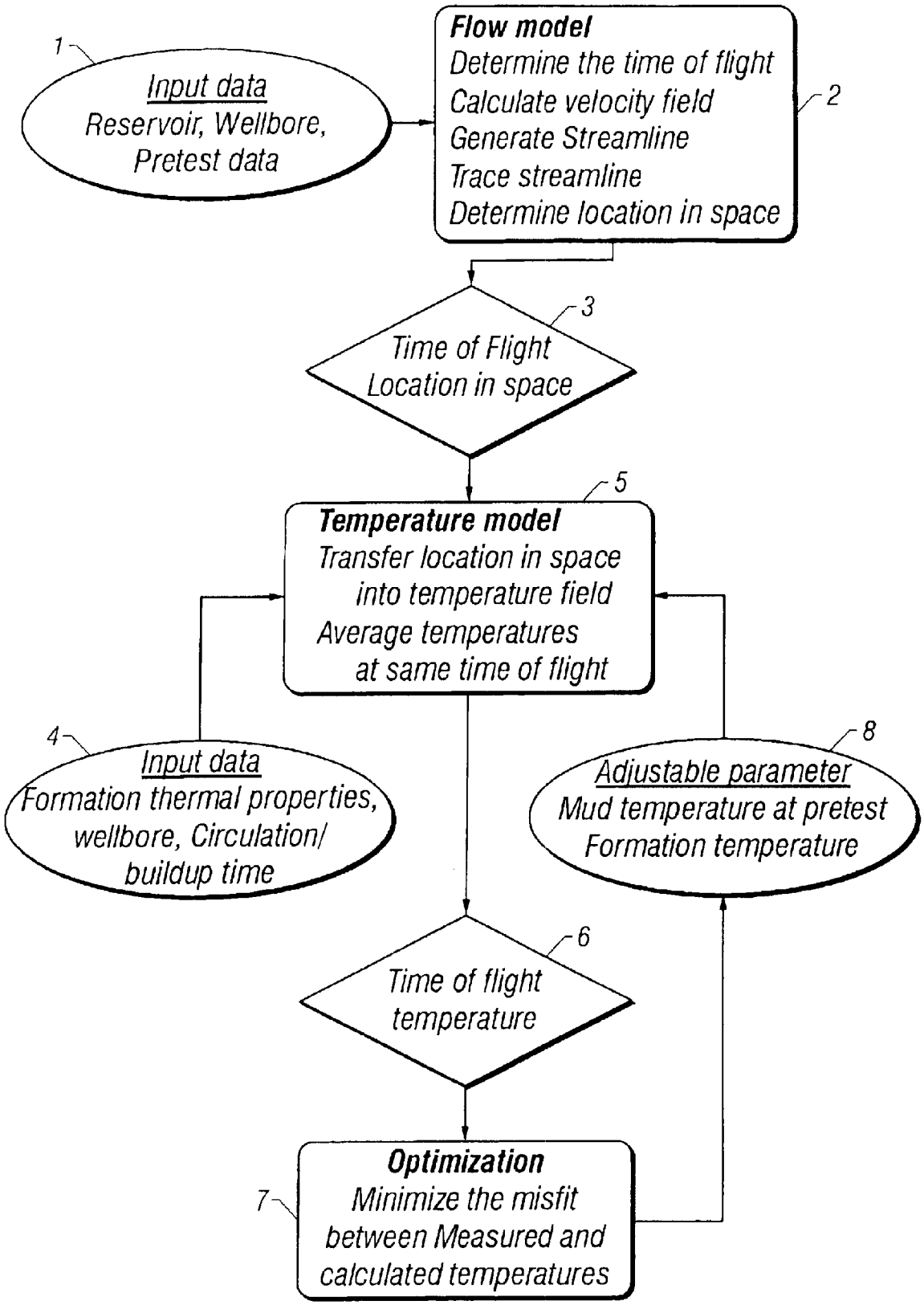
FIG. 7 is a schematic process diagram of the methodology of one embodiment of the present invention.

FIG. 7 is a schematic process diagram illustrating the methodology of one embodiment of the present invention. Box 1 contains the input data that is available, such as reservoir parameters, wellbore data and any pretest data that has been obtained. Box 2 represents the three-dimensional model used to analyze the formation surrounding the wellbore. The modeling of three-dimensional fluid flow through space allows a determination of formation fluid velocities at any point in the formation surrounding the wellbore, at any time. This technique is used to track the position of fluid at any time during the testing, and to determine the time at which fluid at a particular position will enter the wellbore, referred to as the time of flight. Streamlines of the fluid flow are generated and traced which enables the determination of a fluid position in space as a starting point of fluid that enters the wellbore at a certain time. Box 3 shows the parameter of time of flight location in space of formation fluid that will be used within further analysis. Box 4 contains the input data that is available relating to the thermal properties of the formation and wellbore. This data will include an estimate of the drilling fluid temperature within the wellbore and the static formation temperature. Box 5 illustrates the temperature model that is used to convert the location in space data obtained from the flow model into a temperature field. The calculated temperatures for fluids having the same time of flight are averaged to give a calculated fluid temperature at various time of flights (i.e., times at which particular formation fluids enter the wellbore), thereby giving an estimate of the fluid temperature entering the wellbore versus time. Box 6 shows the parameter of time of flight average temperature that gives a calculated formation fluid temperature entering the wellbore versus time that will be utilized for further analysis. Box 7 illustrates the comparison of the calculated temperature versus time data to the measured temperature versus time data that is obtained from the sample probe. The calculated formation fluid temperatures are based on the estimated temperature distribution prior to probe testing. The mud temperature in the wellbore at the end of wellbore fluid circulation and the initial formation temperature are both adjustable in the process of developing calculated temperature (entering the probe) versus time data. Box 8 illustrates how the adjustable parameters of mud temperature and the initial reservoir temperature can be modified and input back into the temperature model shown as Box 5. Since the calculated temperature data is modified by adjusting the mud temperature and the initial reservoir temperature, by repetitive iterations, the error between the calculated and measured temperature data can be minimized, thereby providing an estimate of the static reservoir temperature.

Figure 4:
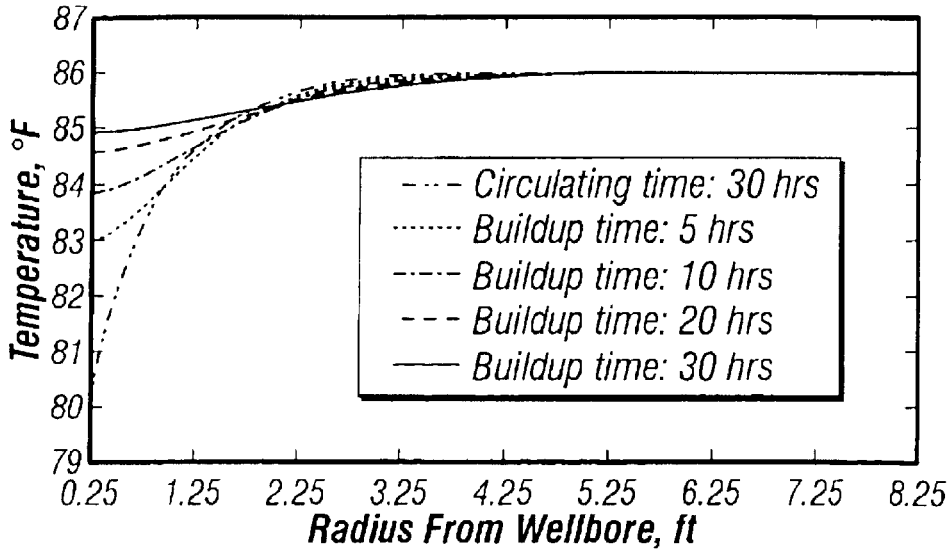
FIG. 4 graphically illustrates an example of radial temperature distribution after wellbore fluid circulation has ceased.

FIG. 4 graphically illustrates the temperature distribution after wellbore fluid circulation has ceased. Temperature distributions along a radial distance from the wellbore at several build up stages are shown. After wellbore fluid circulation stops, the temperature funnel rapidly builds up toward a uniform temperature field, but the buildup becomes increasingly slower, which indicates heat flux decrease with time.

FIG. 5 graphically illustrates the calculated three-dimensional fluid flow profiles at various drawdown times. Due to permeability anisotropy, the flow profiles are elliptic and flatten with time.

Figure 6:
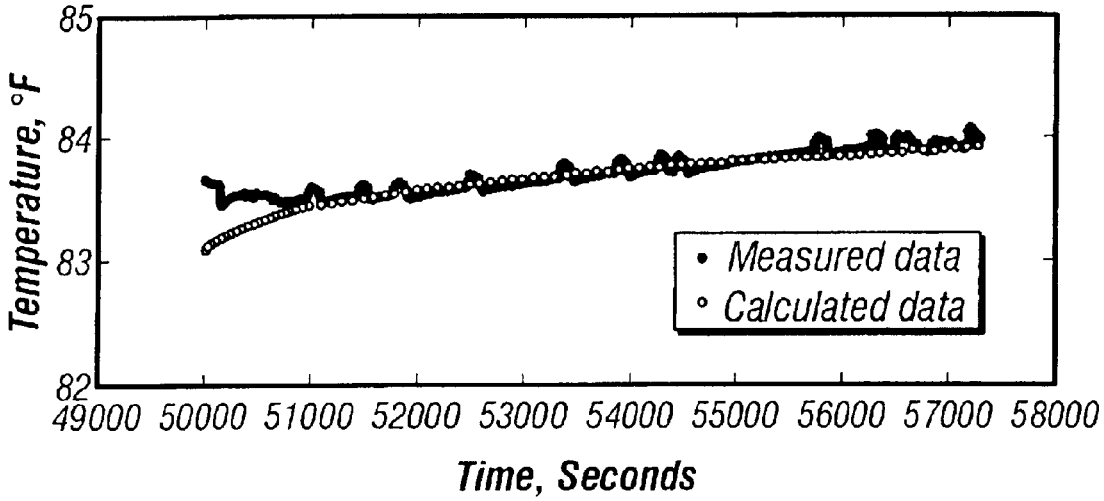
FIG. 6 graphically illustrates an example of calculated and measured temperatures at a sink probe versus elapsed time after wellbore fluid circulation has ceased.

FIG. 6 graphically illustrates the calculated and measured temperatures at the sink probe versus elapsed time after wellbore fluid circulation has ceased. The relationship of the temperature measured at the MDT probe and the calculated temperature versus time is shown for the application example. Good matching results of the calculated temperature plot with the measured temperature plot were obtained for most of the withdrawal time. The early data where the measured data is significantly higher than the calculated data indicates that the initial MDT flow line temperature was higher than the fluid flowing into the tool at that time, however, the measured temperature rapidly decreased to the actual flowing fluid temperature. Prior to the application example testing, the MDT tool had tested deeper intervals (having higher temperatures) during the same run prior to testing the point of interest, which may explain the deviation in the early data. The good match with field data indicates that this approach is feasible and reliable.

One particular embodiment of the present invention involves the estimating of the static formation temperature and the mud temperature within the wellbore after mud circulation has stopped. Using these estimates along with physical properties of the reservoir, circulation times and buildup times (length of time after circulation has stopped), the one-dimensional radial heat flux equations of equations (1) through (4) can be solved. These solutions create a formation temperature profile versus the radial distance from the wellbore at various buildup times, such as shown graphically in FIG. 4. Using an estimated formation fluid withdrawal rate at the wellbore by a sample probe, a three-dimensional fluid flow model of the reservoir can be calculated from equations (5) through (17), establishing a formation fluid location profile at various drawdown (sampling/testing) times, such as shown graphically in FIG. 5. Knowing the drawdown time and the buildup time, the starting points of the fluid movements can be located. These starting point locations can be related to the temperature profile versus radial distance plot in FIG. 4, determining the temperatures for each of these starting locations. These temperatures can be averaged to predict the temperature of the fluid sample that will comprise the combination of fluid from these locations.

By predicting the time that this particular fluid will enter the sample probe from the fluid flow model, and the predicted temperature that this particular fluid will have as it enters the sample probe, a predicted temperature versus time profile for the formation fluid that is withdrawn from the formation by the sample probe can be developed. By inserting a sample probe within the wellbore and engaging it with the wellbore wall, formation fluid can be withdrawn from the formation. The fluid is typically withdrawn at a substantially known rate and at a substantially steady rate to reduce variations in fluid flows through the probe that can alter the test data. If the fluid withdrawal rate is substantially different than the estimated fluid withdrawal rate used in the fluid flow model, the fluid flow may need to be recalculated with the actual fluid flow rate. The temperature of the formation fluid passing through the probe at the wellbore is measured, which creates an observed formation fluid temperature versus time profile.

The error between the observed formation fluid temperature at the wellbore versus time profile and the calculated formation fluid temperature at the wellbore versus time profile can be quantified mathematically, such as by equation (18). Since the calculated formation fluid temperature at the wellbore versus time profile is dependant on the estimates of the static formation temperature and the mud temperature within the wellbore, these estimates can be modified and a revised calculated formation fluid temperature at the wellbore versus time profile generated.

The predicted static formation temperature can be obtained by repeating the iteration of modifying the estimated static formation fluid temperature and wellbore fluid temperature variables, and generating a revised calculated formation fluid temperature at the wellbore versus time profile, until the error between the calculated formation fluid temperature at the wellbore versus time profile and the observed formation fluid temperature at the wellbore versus time profile is minimized.

What is claimed is:

1. A method of calculating a static formation temperature in a reservoir penetrated by a wellbore; comprising:

estimating the static formation temperature;

calculating a formation fluid temperature at the wellbore using a three-dimensional fluid flow model through the reservoir, said calculation based, at least in part, on the estimated static formation temperature;

measuring the temperature of a sample of formation fluid at the wellbore;

comparing the calculated formation fluid temperature at the wellbore with the measured temperature of the sample of formation fluid; and predicting the static formation temperature by altering the estimate of the static formation temperature until an error between the calculated formation fluid temperature at the wellbore and the measured formation fluid temperature is minimized.

2. The method of claim 1, wherein the calculation of formation fluid temperature at the wellbore comprises solving radial heat flux equations.

3. The method of claim 1, wherein the three-dimensional fluid flow model through the reservoir is developed using an estimated formation fluid withdrawal rate at the wellbore.

4. The method of claim 1, further comprising:

inserting a sink probe within the wellbore;

engaging the sink probe with the formation at a wellbore wall; and removing fluid from the formation at the wellbore by the sink probe at a substantially known withdrawal rate.

5. The method of claim 4, wherein the sink probe is rim into the wellbore on a wireline.

6. The method of claim 4, wherein the sink probe is rim into the wellbore on a tubular string.

7. The method of claim 1, wherein the calculation of formation fluid temperature at the wellbore comprises solving radial heat flux equations in conjunction with a three-dimensional fluid flow model to develop a calculated fluid formation temperature at the wellbore versus time profile.

8. The method of claim 7, wherein the measured temperature of a sample of formation fluid at the wellbore is used to develop a measured temperature of a sample of formation fluid at the wellbore versus time profile.

9. The method of claim 8, wherein the error between the measured temperature of a sample of formation fluid at the wellbore versus time profile and the calculated formation fluid temperature at the wellbore versus time profile is quantified.

10. The method of claim 9, wherein the static formation temperature is predicted by minimizing the error between the measured temperature of a sample of formation fluid at the wellbore versus time profile and the calculated formation fluid temperature at the wellbore versus time profile.

11. A method of calculating a static formation temperature in a reservoir penetrated by a wellbore, comprising:

estimating the static formation temperature in the reservoir and a wellbore fluid temperature;

creating a calculated formation fluid temperature at the wellbore versus time profile for fluid removed from the formation by a sink probe, based upon, in part on the estimates of the static formation temperature in the reservoir and the wellbore fluid temperature;

measuring the temperature of the formation fluid at the wellbore removed from the formation by the sink probe, and creating a measured fluid formation temperature at the wellbore versus time profile;

comparing the measured fluid formation temperature at the wellbore versus time profile to the calculated formation fluid temperature at the wellbore versus time profile; and predicting the static formation temperature by altering the estimates of the static formation temperature in the reservoir and a wellbore fluid temperature until the error between the measured fluid formation temperature at the wellbore versus time profile to the calculated formation fluid temperature at the wellbore versus time profile is minimized.

12. The method of claim 11, further comprising:

inserting a sink probe within the wellbore;

engaging the sink probe with a wellbore wall; and removing fluid from tire formation at the wellbore by the sink probe at a substantially known withdrawal rate.

13. The method of claim 12, wherein the sink probe is run into the wellbore on a wireline.

14. The method of claim 12, wherein the sink probe is run into the wellbore on a tubular string.

15. The method of claim 12, wherein the sink probe is nm into the wellbore after wellbore fluid circulation within the wellbore has ceased.

16. A method of predicting the static formation temperature in a reservoir penetrated by a wellbore, comprising:

estimating the static formation temperature;

estimating a wellbore fluid temperature;

calculating a calculated formation fluid temperature versus radial distance profile using one-dimensional radial heat flux equations;

calculating a three-dimensional fluid flow model of the reservoir utilizing an estimated formation fluid withdrawal rate at the wellbore, thereby establishing a formation fluid location versus time profile;

combining the calculated formation fluid temperature versus radial distance profile with the formation fluid location versus time profile to create a calculated formation fluid temperature at the wellbore versus time profile;

removing fluid from the formation at the wellbore at a substantially known and substantially constant withdrawal rate;

measuring the temperature of the formation fluid upon removal from the formation;

creating an observed formation fluid temperature at the wellbore versus time profile;

quantifying the error between the observed formation fluid temperature at the wellbore versus time profile and the calculated formation fluid temperature at the wellbore versus time profile;

modifying the estimates of the static formation fluid temperature and the wellbore fluid temperature;

generating a revised calculated formation fluid temperature at the wellbore versus time profile; and predicting the static formation temperature by repeating the iteration of modifying the estimated static formation fluid temperature and wellbore fluid temperature variables, and generating a revised calculated formation fluid temperature at the wellbore versus time profile, until the error between the calculated formation fluid temperature at the wellbore versus time profile and the observed formation fluid temperature at the wellbore versus time profile is minimized.

17. The method of claim 16, further comprising:

inserting a sink probe within the wellbore;

engaging the sink probe with a wellbore wall; and removing fluid from the formation at the wellbore by the sink probe at a substantially known withdrawal rate.

18. The method of claim 17, wherein the sink probe in nm into the wellbore on a wireline.

19. The method of claim 17, wherein the sink probe is run into the wellbore on a tubular string.

20. The method of claim 17, wherein the sink probe is run into the wellbore after wellbore fluid circulation within the wellbore has ceased.

* * * * *